United States Patent [19]

Edminster

[11] 4,341,159

[45] Jul. 27, 1982

[54] RETARD SENSING DOUBLE RELEASE SAFE SEPARATION MUNITION TIMER

[75] Inventor: Robert E. Edminster, Scottsdale, Ariz.

[73] Assignee: Motorola Inc., Schaumburg, Ill.

[21] Appl. No.: 169,545

[22] Filed: Jul. 17, 1980

[51] Int. Cl.[3] ..... F42C 15/12

[52] U.S. Cl. ..... 102/228; 102/268; 102/276

[58] Field of Search ..... 102/228, 221, 268, 276, 102/215

[56] References Cited

U.S. PATENT DOCUMENTS

| | | | |
|---|---|---|---|
| 3,337,701 | 8/1967 | Prebilic | 102/276 X |
| 3,382,805 | 5/1968 | Swaim | 102/228 |
| 3,614,930 | 10/1971 | Brackman et al. | 102/276 X |
| 3,780,659 | 12/1973 | Kulesza et al. | 102/228 |
| 3,842,743 | 10/1974 | Zittle | 102/228 |
| 4,099,466 | 7/1978 | Redmond et al. | 102/215 |
| 4,215,634 | 8/1980 | Forsberg | 102/228 |

*Primary Examiner*—David H. Brown

*Attorney, Agent, or Firm*—M. Davis Shapiro

[57] ABSTRACT

A safing and arming timer being responsive to sequentially sampled deceleration forces to operate in one of a non-retard or retard mode wherein different non-retard and retard safe separation times may be predetermined and sequential outputs are available for sequential control of two different output functions.

5 Claims, 15 Drawing Figures

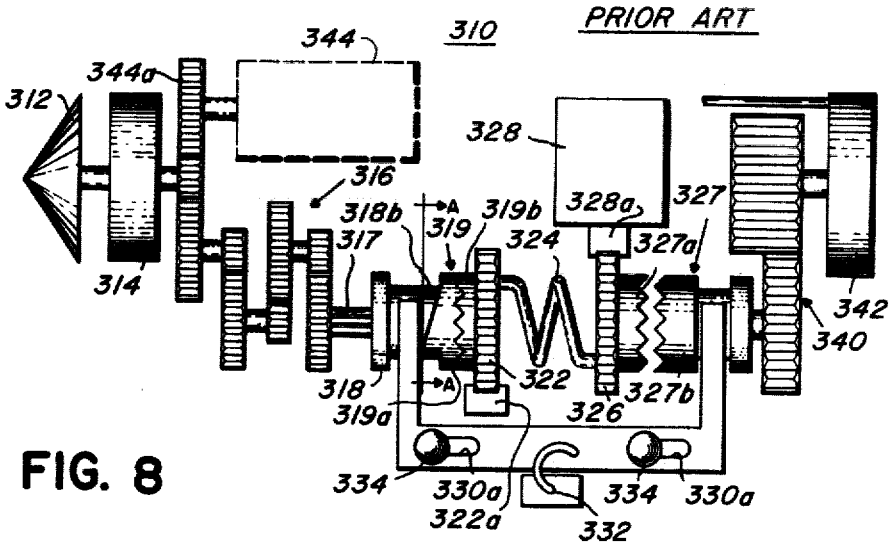
FIG. 8
FIG. 11A
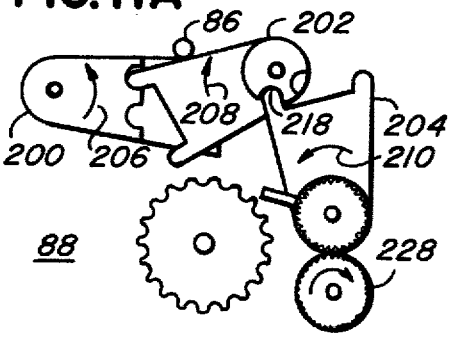
FIG. 11B
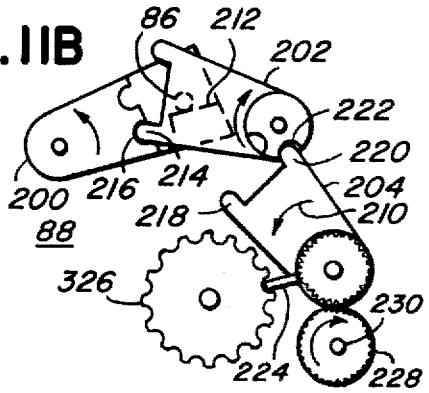
FIG. 11C
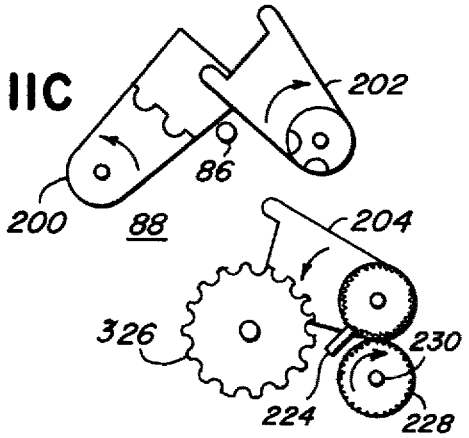

RETARD SENSING DOUBLE RELEASE SAFE SEPARATION MUNITION TIMER

FIELD OF THE INVENTION

The invention relates to retard sensing for a bomb fuze safing and arming system timer.

BACKGROUND OF THE INVENTION

Free fall high explosive bombs are of two types: (1) low drag, generally for use in drops from above about five thousand feet, and (2) high drag, generally for use in drops from lower altitudes. An integral proximity fuze has been developed for use with the low drag (higher altitude) bombs, but there is no such fuze available having the necessary short arm times required for high drag, low altitude service. Generally, safe separation time and drop mode are determined before the carrying aircraft leaves the ground. This limits the flexibility of the flight plan.

SUMMARY OF THE INVENTION

The retard sensing mechanism of the instant invention makes it possible to modify the existing low drag-high altitude integral proximity fuze design to provide a single fuze which may serve both low and high drag applications. This is accomplished by sensing the deceleration forces perculiar to high drag operation and to automatically reduce the fuze arm time accordingly. The invention utilizes a retard sensing double release clock for providing the necessary dual arm times.

It is therefore an object of the invention to provide automatic retard sensing.

It is another object of the invention to provide retard sensing and to use that sensing to alter the arm time function responsive thereto.

It is still another object of the invention to provide a safing and arming system in a fuze which may be utilized on a high or a low drag munition without any special operator considerations as to the fuze settings at the time of drop.

These and other objects of the invention will be more clearly understood upon review of the Detailed Description of the Invention which follows together with the drawings in which:

FIG. 1 pictorially represents the operation of the fuze of the invention in both the high and low drag modes of operation;

FIG. 8 is a drawing depicting a prior art turbine operated safing and arming system;

FIG. 11A depicts a view of the output mechanism of the timer of the invention at prelaunch time;

FIG. 11B depicts the output mechanism of the timer of the invention at the time of turbine unlock;

FIG. 11C depicts the output mechanism of the timer of the invention at arm time;

Figure 9:
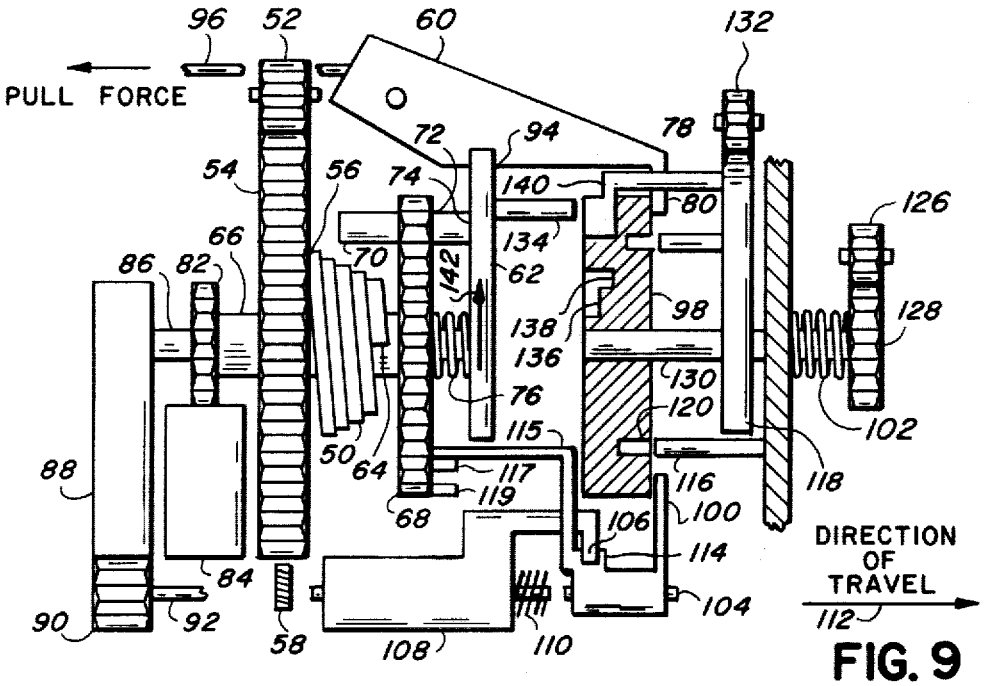
FIG. 9 is a view of the timer of the invention in a prelaunch configuration.
Figure 12:
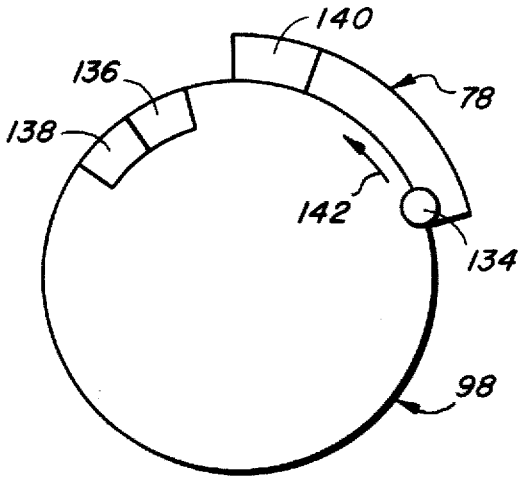
Figure 13:
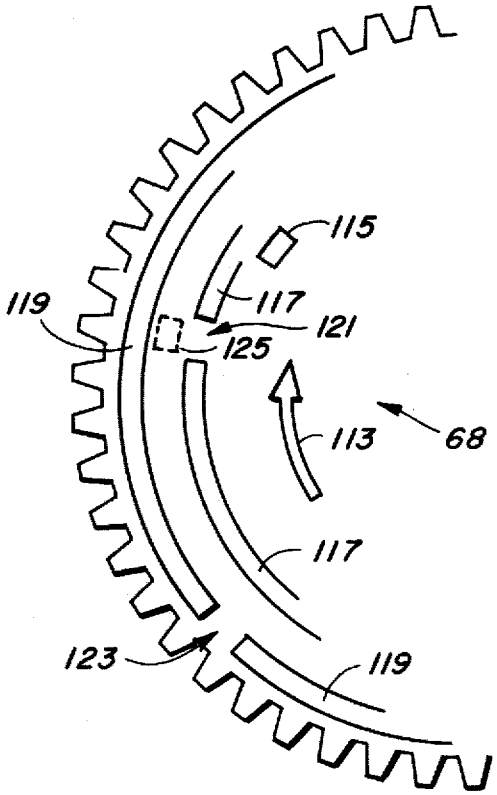

FIG. 12 is a view of timing cams 98 and 78 of FIG. 9 as seen looking in the direction of travel 112; and FIG. 13 is a view of drive disc 68 of FIG. 9 as seen looking against direction of travel 112.

DETAILED DESCRIPTION OF THE INVENTION

Figure 1:
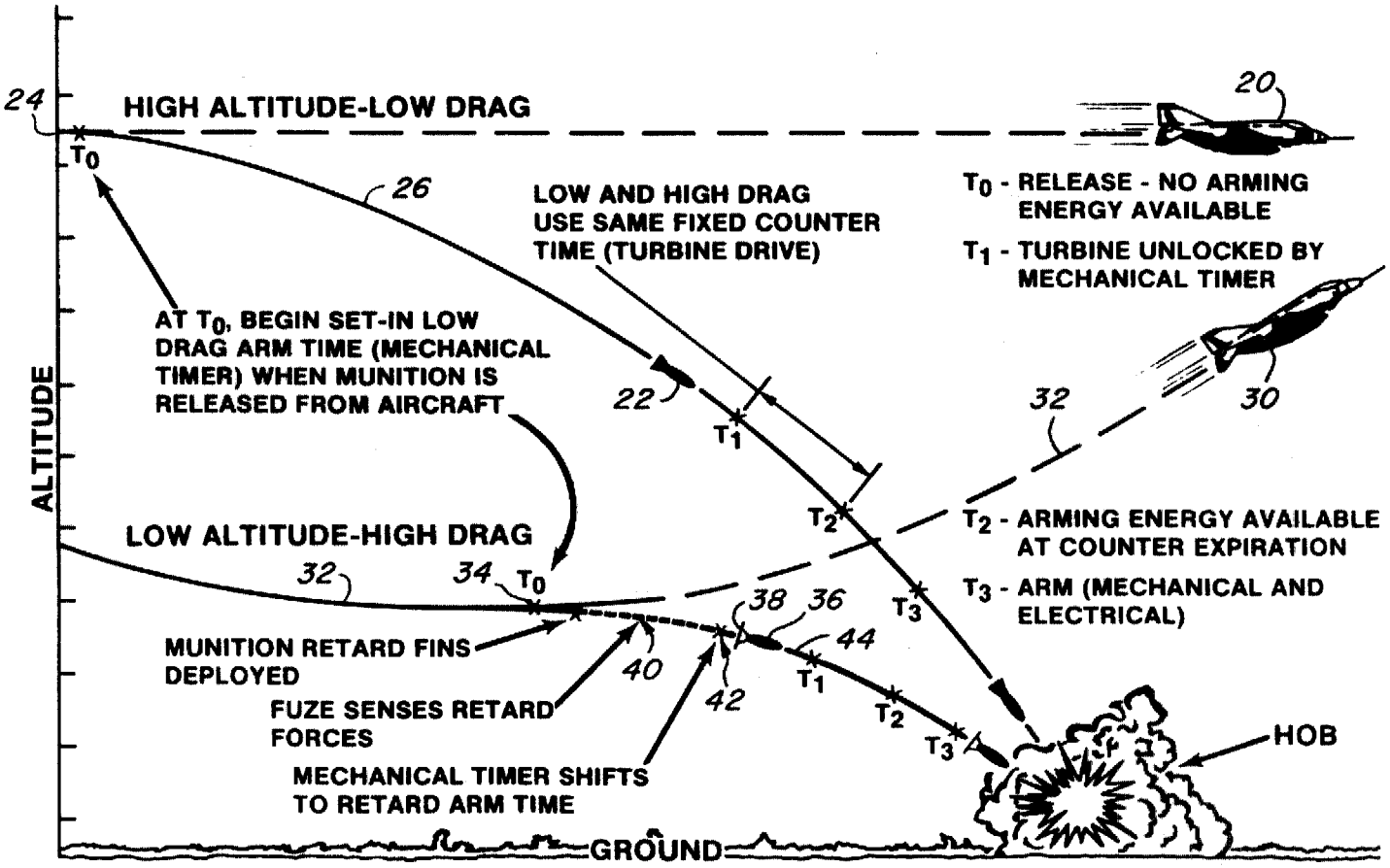

The pictorial representation of FIG. 1 serves to illustrate the basic difference between a flight profile for a high altitude/low drag munition and a low altitude/-high drag munition. In the high altitude/low drag mode, aircraft 20 releases the munition 22 at point 24 and time $T_0$. Munition 22 traverses ballistic path 26. As indicated at time $T_0$, release time, no arming energy is available in the munitions fuze. This lack of arming energy is generally dictated by safety requirements. At time $T_0$ the timer of the instant invention is allowed to begin running. When the timer has run to time $T_1$, as shown on ballistic path 26, a turbine in the fuze is unlocked by the output of the timer. The turbine, operating through a governor and a gear train does a mechanical count for the fixed delay time between $T_1$ and $T_2$ on ballistic path 26. As the counter expires at time $T_2$, arming energy is available in the fuze. At time $T_3$, determined by the timer of the instant invention, the fuze is armed, both mechanically and electrically, allowing a sensor to detonate the munition at height of burst (HOB) as shown, as long as HOB occurs after time $T_3$. Munition 22 has followed a simple ballistic path from launch to height of burst. The tail fin configuration of such a munition is minimal, that is; sufficient to keep the munition aligned so that its axis substantially follows the flight path.

For comparative purposes, aircraft 30 is depicted in a flight path 32 for low altitude/high drag operation. At point 34, time $T_0$, munition 36 is released from aircraft 30. The aircraft operation controls a lanyard which causes drag fins 38 to be deployed upon release from the aircraft. At approximately point 40 the fuze timer of the instant invention senses retard forces caused by the deployment of retard fins 38. At approximately point 42, the mechanical timer of the instant invention causes (as a result of sensing the retard forces) the preset retard arm time to be enabled in place of the non-retard arm time. At time $T_1$ along ballistic path 44 the energy source turbine in munition 36 fuze is unlocked by the mechanical timer. The turbine acting through a governor and a gear train operates to count the time between time $T_1$ and time $T_2$ as was the case in the high altitude-low drag configuration. At time $T_2$ on ballistic path 44 munition 36 fuze has arming energy available but not yet released by the retard mechanism. At time $T_3$ on ballistic path 44 the preset safe separation time has elapsed and the fuze is armed both mechanically and electrically and proceeds to HOB. Of course, the purpose of the retard mechanism is to sense retardation and switch to a short safe separation time allowing aircraft 30 to be clear of munition 36 before arming and clear of the HOB point before detonation. Safe separation from HOB is not a requirement in the high altitude-low drag situation since aircraft 20 has enough altitude above HOB to provide safe transit.

The mechanical timer of the instant invention which provides the timing functions described above is explained herewith. FIG. 9 shows the elements of a preferred embodiment of the time in its configuration before release from the aircraft. Main spring 50 may be wound and the timing calibrated during the fabrication of the timer by an input from pinion 52. Pinion 52 engages gear 54 which is connected to end 56 of main spring 50. Pinion 52 may then be removed after set screw 58 is used to lock gear 54 in place (see FIG. 10). Latch 60 is locked to cam follower 62 to prevent rotation of cam follower 62 under the urging of main spring 50. Other end 64 of mainspring 50 is attached to main shaft 66. Main shaft 66 is also fixed to gear 68. Pin 70 is engaged in hole 72 in gear 68 and is also fixed to cam follower 62 at point 74. The arrangement thus described prevents main spring 50 from unwinding. Compression spring 76 urges cam follower 62 to move to the right, that is against cams 78 and 98. Feature 80 of latch 60 prevents cam 98 from moving. Main shaft 66 is coupled through gear 82 to escapement mechanism 84. Escape mechanism 84, which governs the rotational speed of the timer, is not described in detail since it will be well understood by one skilled in mechanical timer art. Cam follower shaft 86, which is fixed to cam follower 62, is coupled to output mechanism 88 (not shown in detail in FIG. 9). The detail of output mechanism 88 will be discussed, infra. Mechanism 88 drives gear 90 whose output shaft 92 controls rotation of the fuse turbine. (Not shown.) For details concerning a prior art safing and arming system driven by a turbine see U.S. Pat. No. 3,842,743 by Cyrus M. Zittle, assigned to the assignee of this application. FIG. 8 is typical of such prior art.

(Refer again to FIG. 9.) As has been before mentioned, latch mechanism 60 locks cam follower 62 at point 94 prior to release of the munition from the carrying aircraft. Timing cam wheel 98 has been preset to a particular position corresponding to a desired non-retard safe separation time by means of input pinion 126, intermediate gear 128 and shaft 130. This would, of course, be accomplished before the carrying aircraft left the ground. Timing cam wheel 98 sets the time for the non-retard operation of the fuze. Cam 78, which is set by means of input pinion 132 and retard set gear 118, controls the retard timing function.

Figure 10:
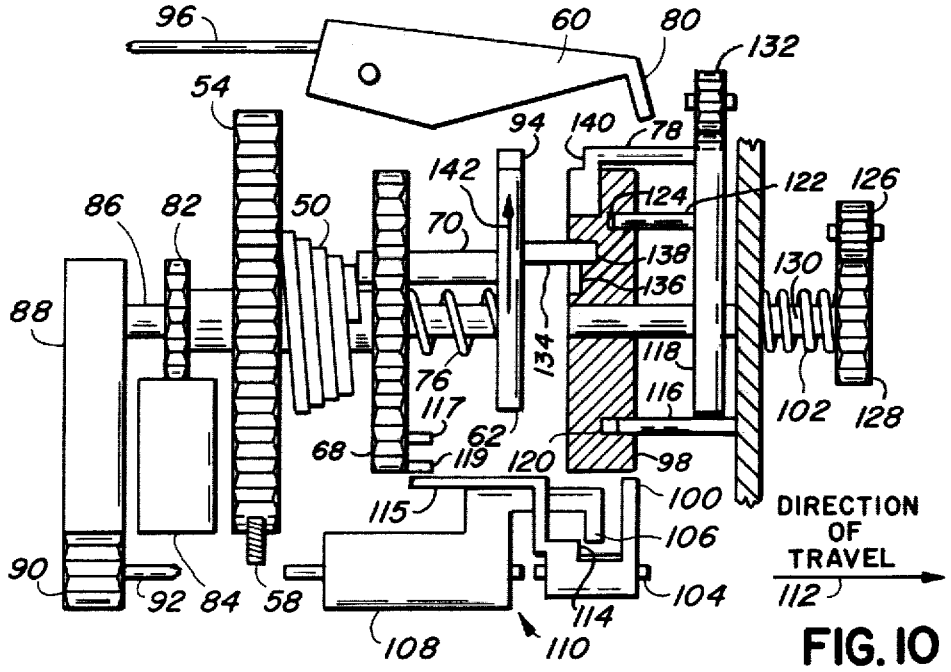
FIG. 10 shows the timer of the invention after munition release.

Upon release, lanyard 96 is pulled by reason of its being connected to the aircraft carrying the munition, releasing cam follower 62 at point 94 so that it may rotate and releasing cam 98 at point 80. Cam follower wheel 62 has cam follower 134 mounted thereto. Cam follower 134 follows either retard cam 78 or cam wheel timer 98 and moves in direction 142 (see FIG. 12). FIG. 12 is a view of cams 78 and 98 of FIGS. 9 and 10 as seen when viewed in the direction of travel 112. Note that cam follower 134 overlaps both cams. If retard inertia mass 108 is not activated by the dispersion of fins 38, see FIG. 1, cam follower 134 rotates upon the urging of main spring 50 and rides on retard cam 78 and main timing cam 98 simultaneously. When cam follower 134 gets to the first step in cam wheel 98 it drops into position 136, allowing cam follower shaft 86 to be partially withdrawn from the output mechanism 88 (which will be further described, infra). As cam follower 134 continues to rotate it drops in to step 138 on cam follower 98 allowing main cam follower shaft 86 to be completely withdrawn from the output mechanism 88. The released condition is portrayed in FIG. 10. Note that retard latch 100, FIG. 9, prevents timing cam 98 from moving forward under urging from compression spring 102. Latch 100 is restricted from rotation about shaft 104 by means of latch 106 (a part of weight 108) and compression spring 110 acting in concert. Since the timer of FIG. 9 is oriented within the carrying munition so that it travels in the direction 112, a retard force such as would be applied by the extension of retard fins 38 (see FIG. 1) causes mass 108 to move against the urging of compression spring 110 in direction of travel 112. Retard lock mechanism 114 is inhibited from rotation by means of projection 106 on retard inertia member 108. When inertia mechanism 108 moves to the right, as shown in FIG. 10, latch feature 106 moves away from the mating portion of retard lock 114 allowing it to rotate counter clockwise, as viewed from the front of the munition, so that locking feature 100 clears cam 98 and allows cam 98 to move forward under the urging of compression spring 102. Pin 122 mounted on retard set gear 118 engages a slot 124 of timing cam 98 if cam 78 of retard set gear 118 is set to one of the retard mode time settings. If cam 78 of retard set gear 118 is set to the "NO RETARD" mode, pin 122 rides on the surface of cam 98, thereby restricting its forward motion. Pin 116 drops into one of a plurality of timing hole locks 120 so that timing cam 98 is then locked. This precludes any possibility of movement in cam wheel 98 after the timer senses retard or no-retard.

If mass 108 is urged forward by deceleration caused in turn by extension of retard fins 38 (see FIG. 1), latch mechanism 106 (see FIG. 10) releases the mating latch 114 allowing latch feature 100 to disengage from main timing cam 98. However, gear 68 engages interlock feature 115 of retard latch 100 by means of flange rings 117 and 119. Referring also to FIG. 13, a view of gear 68 as seen looking against direction of travel 112, flange ring 117 restrains interlock 115 until gear 68 travels in direction 113 for 0.5 seconds. At that time, opening gate 121 in flange ring 117 allows interlock 115 to move into position 125 if retard weight 108 is urged forward by deceleration forces at that time. As gear 68 continues to travel in direction 113, a second opening gate 123 in flange ring 119 allows it to release completely. This occurs at a travel time of 0.8 seconds if retard weight 108 is urged forward by deceleration forces at that time. This allows main timing cam 98 (see FIG. 10) to move forward upon the urging of compression spring 102, as has been previously explained. As cam follower 134 is urged to rotate by mainspring 50 under these conditions, it will first drop onto step 140 of retard cam 78 (see also FIG. 12) at which time cam follower shaft 86 is partially withdrawn from the output mechanism 88. As cam follower 134 continues to rotate it falls off the end of step 140 in retard cam 78 allowing main cam shaft 86 to be totally withdrawn from output mechanism 88. Thus it may be seen that either of two preselected time periods may be utilized to first partially and then fully withdraw cam shaft 86 from output mechanism 88.

FIG. 11A is a rear view of output mechanism 88 shown in block form in FIGS. 9 and 10. FIG. 11A represents the locked up position of output mechanism 88, that is, before cam shaft 86 is first partially withdrawn (away from the viewer in FIG. 11). Rotary elements 200, 202 and 204 are urged to move in directions of arrows 206, 208 and 210, respectively, but all such motion is restricted by cam 62 shaft 86. When shaft 86 is withdrawn partially from output mechanism 88 as shown in FIG. 11B, rotary member 200 is urged against shaft 86 where it is stopped when protruding lug 212 below member 200 strikes the side of shaft 86. Lug 214 of rotary member 202 engages slot 216 in rotary member 200 thereby stopping its motion. Lug 218 (see FIG. 11A) is released from rotary member 202 by reason of its rotation in direction 208 and rotary member 204 is then free to move counter-clockwise (in direction of arrow 210) until lug 220 engages slot 222 in rotary member 202 thereby stopping rotary member 204 in its counter-clockwise motion. Locking lug 224 now engages toothed member 326, a part of the prior art assembly shown in FIG. 8 and labelled therein by the same reference numeral 326. Thus the function of timer 328 of FIG. 8 is accomplished by the the timer of the instant invention via output mechanism 88. Referring back to FIG. 11B, output shaft 230 has now been rotated far enough so that a clutch mechanism (not shown but coupled to turbine wheel 312 of FIG. 8) is released so that turbine wheel 312 (FIG. 8) may rotate and wind spring 324 (FIG. 8). Since output toothed wheel 326 of FIG. 8 is locked by locking pin 224 (see FIG. 11B) energy may then be stored in spring 324. In FIG. 11C shaft 86 has been completely withdrawn from mechanism 88, as previously described. Rotating members 200 and 202 have turned so that they are free of rotating member 204. This allows rotating member 204 to turn further counterclockwise so that locking pin 224 is now free of output toothed gear 326 (see also FIG. 8). While output gear 228 and shaft 230 turn still further clockwise, no further effect is had on the clutch which controls turbine 312 (FIG. 8). At the time when locking pin 224 is released from output wheel 326, the stored energy in spring 324 (FIG. 8) is free to be released into rotor 343 which carries the fuze's detonator. The operation of this mechanism is as described in U.S. Pat. No. 3,842,743, as previously referenced.

For the reader's convenience, FIG. 8 of this patent application is identical to FIG. 1 of U.S. Pat. No. 3,842,743 except that all reference numerals have been preceded by a 3 so that they are all in a three hundred series.

Certain safety improvements are inherent in the design of this clock. It is, therefore, not necessary to utilize a relatively expensive electronic speed monitor for monitoring the clock wind down speed in order to inhibit the fuzing function if there is a clock escapement "zip" failure. By utilizing a clock with a two stage release, the clock monitor is eliminated without sacrificing safety. The clock starts the fuze counter which winds the safing and arming spring and times out against the counter for a specific period of time. If the clock "zips" during this time comparison (or is zipping when the time comparison starts), it will time out first and the fuze will not arm. This out of sequence logic is also in the prior art fuze design. This design allows the use of any reliable ordinance escapement and precludes the need for the electronic speed monitor. By starting the mechanical counter a short time before the actual arm time, the time period between that when the counter winds the safing and arming rotor spring to when the clock releases the rotor spring to turn the rotor, can be kept to a minimum. A 0.4 second exposure time is used in the retard fuze timer design of the invention. See FIG. 7. This system allows the counter to track each individual arm time, as set. For example, the counter is started the same number of seconds before a five second preset arm time as for an eighteen second preset arm time. This eliminates progressively longer exposure times between counter and arm time setting (as is in the prior art fuze) as the arm time settings progress from five to eighteen seconds.

This release concept ensures that a possible clock zip failure cannot arm the fuze earlier than 0.4 seconds before the desired safe separation time. If the clock should have a zip failure at any time before this exposure time, no spring energy would be stored and the fuze would not arm. This two stage release is accomplished by a double shift of the clock time disk. As time disk 62 (FIG. 9) rotates, it reaches step notch 136 or 140 in set disk 98 or cam 78. Time disk 62 moves axially forward into the first step of the notch, releasing the first stage of the output levers, which releases the locked turbine and allows winding of the safing and arming spring.

Time disk 68 rotates further to the second step of the notch and moves axially forward again, releasing the second stage of the output levers which releases the stored spring energy to rotate the safing and arming rotor. The clock first stage output unlocks the turbine and the clock second stage output unlocks the safing and arming rotor spring. The operation sequence is as follows:

(a) The clock set disk notch is preset to the desired safe separation time by rotating the fuze arm time ring.

(b) The clock drive shaft is rotated by the prewound power spring.

(c) The clock drive shaft is speed controlled by the escapement.

(d) The lanyard pull rod trips the clock power spring, starting the clock.

(e) The time disk moves axially forward when the tab enters the first notch and releases the primary output lever to move one-half of its total travel which releases the turbine so that it may rotate.

(f) The turbine rotates the gear train, winding the safing and arming rotor spring.

(g) When the safing and arming spring is wound, the gear train shifts a clutch, engaging the safing and arming rotor.

(h) After sufficient time interval (1.4 seconds) to allow the turbine to wind the safing and arming rotor spring, the rotating time disk reaches the second step of the notch and moves axially forward again. The primary output level is then fully released, releasing the safing and arming spring energy to rotate the safing and arming rotor, thereby arming the fuze.

The turbine lock which is released by the clock 1.8 seconds before the arm time holds the turbine by a shaft which extends from the clock output gear forward, locking the turbine by a flange on the governor shoe. When the clock releases the primary output lever, the lock shaft is free to rotate releasing the turbine. The lock shaft is identified as reference numeral 92 in FIGS. 9 and 10, and as 230 in FIG. 11.

The fuze has a turbine threshold device which locks the turbine below about 250 knots air speed. To enable continued use of this prior art safety feature on a retard fuze that operates below 250 knots, the turbine is arranged to be free to rotate one-half turn at munition release time, $T_0$, thereby overcoming the threshold device. It is then locked by the clock until 1.8 seconds before arm time. Munition release is made at speeds in excess of 250 knots. The 0.4 second exposure time of the retard fuze results from the turbine being released 1.8 second before any arm time and subtracted from this is the counter wind time of 1.4 seconds. The shorter counter wind time was accomplished by changing the counter gear train in the prior art fuze. The shorter wind time permits a shorter exposure time and permits the arming of the fuze within the short retard times (2.6 or 4.0 seconds).

The retard arm time is selected by a second arm time ring which has been added to the prior art fuze adjacent the already present low drag arm time ring. The retard arm ring has three settings, "NO RETARD", "2.6" and "4.0" seconds. The "NO RETARD" setting locks out the retard function. Both arm time rings engage the clock by rotating small idler gears.

Figure 7:
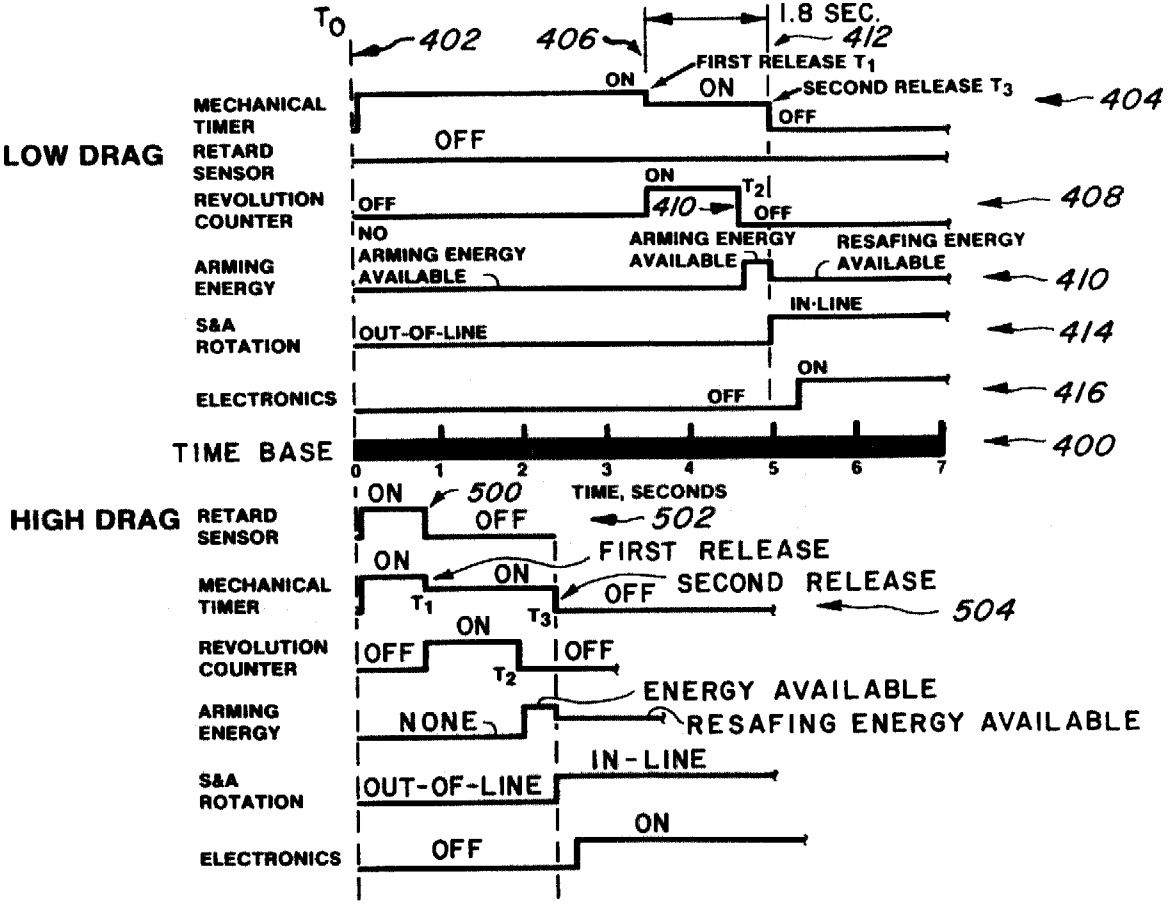
FIG. 7 is a chart comparing the timing of the invention in the low drag and high drag modes of operation.

Conversion to the retard function occurs 1.8 seconds before arm time. At this time the normal double release mechanism in the clock is operated, starting the counter in the same sequence as in any normal arm time. Arming occurs at 2.6 or 4 seconds as selected instead of at the normally set arm time. FIG. 7 is a timing chart of the fuze operation. References $T_0$, $T_1$, $T_2$ and $T_3$ in FIG. 7 are directly relatable to the same references in FIG. 1. The timing diagrams above time reference base 400 are illustrative of the low drag operation of the fuze. The timing diagrams below time reference base 400 are illustrative of high drag operation of the fuze. Lanyard pull occurs at time $T_0$ as indicated by reference numeral 402.

The low drag operation of the mechanical timer of the invention is shown at reference numeral 404. The timer is enabled and begins to run at time $T_0$ indicated at reference numeral 402. First release 406 occurs at time $T_1$. This first release at time $T_1$ operates to lock gear 326, and unlock turbine 312 by rotation of shaft 230, see FIGS. 8 and 11B. Locking of gear 326 enables spring 324, the spring from which the fuze gets its arming energy, to wind. The turbine driven revolution counter begins to wind spring 324 at time $T_1$, see also FIG. 8. See also, reference numeral 408 of FIG. 7. By time $T_2$, see reference numeral 410 of timing diagram 408, spring 324 (see FIG. 8) is wound and arming energy is available. See timing diagram for arming energy, 410. Upon the second release of the mechanical timer of the invention at time $T_3$, reference numeral 412, the safing and arming disk is rotated in line, see reference numeral 414. After a short delay, the electronics in the system are turned on, see reference numeral 416. Note that the time between $T_0$, 402 and $T_1$, 406 is determined by the setting of mechanical timer for high or low drag operation. The time between first release 406 at time $T_1$ and second release 412 at time $T_3$ is always a constant 1.8 seconds. This is determined by timing disk 98, see FIG. 9.

The similarities between low drag operation as just described and high drag operation as shown below time base 400 in FIG. 7, are readily recognized. The timing diagrams for high drag operation subsequent to time $T_1$, reference numeral 500, are identical to those for low drag operation shown above timing base 400. The differences occur between time $T_0$ and time $T_1$. The retard sensor of the timer of the invention is actuated shortly after time $T_0$, release time from the aircraft. This may be seen in the retard sensor timing diagram 502. The retard sensor is actuated by dispersal or deployment of munition retard fins 38, see FIG. 1. This is accomplished directly after lanyard pull upon release of the munition from the aircraft. Because the retard sensor is actuated, the mechanical timer operates in the retard mode which may be seen clearly from the timing diagram for the timer, 504. First release time $T_1$ occurs much earlier, as shown in FIG. 7, because of the relatively short mechanical timer settings for retard operation. Note that after time $T_1$, first release time, 500, the timing diagrams are identical to those for low drag operation except that they are advanced in time. The revolution counter begins to count at time $T_1$ just as in the low drag operation but because time $T_1$ occurs earlier, the revolution counter also begins earlier.

Figure 2:
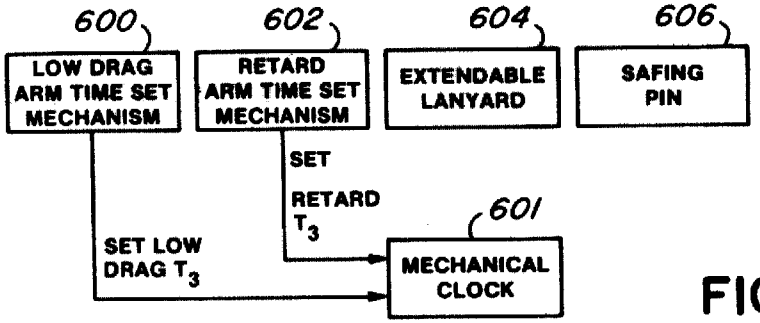
FIG. 2 represents, in block diagram form, a flowchart for operations to be performed before takeoff.

FIG. 2 is a flowchart of the fuze of the invention showing the functions of the fuze which are either operable or which represent safety features before takeoff of the carrying aircraft. Low drag arm time set mechanism 600 must be set at this time. In essence this sets second release time $T_3$ into the mechanical clock of the invention for low drag operation only. Retard arm time set mechanism 602 is set before takeoff to provide time $T_3$ second release information to the mechanical clock for retard operation. Extendable lanyard 604 is connected from the fuze to the carrying aircraft prior to takeoff so that upon munition drop, the lanyard will be pulled. Safing pin 606 is left in place to assure that RAM air inlet cover 608 and air exhaust cover 610 (FIG. 3) remain closed. Safing pin 606 must be removed before takeoff in order to allow the fuze to operate upon release from the carrying aircraft.

Figure 3:
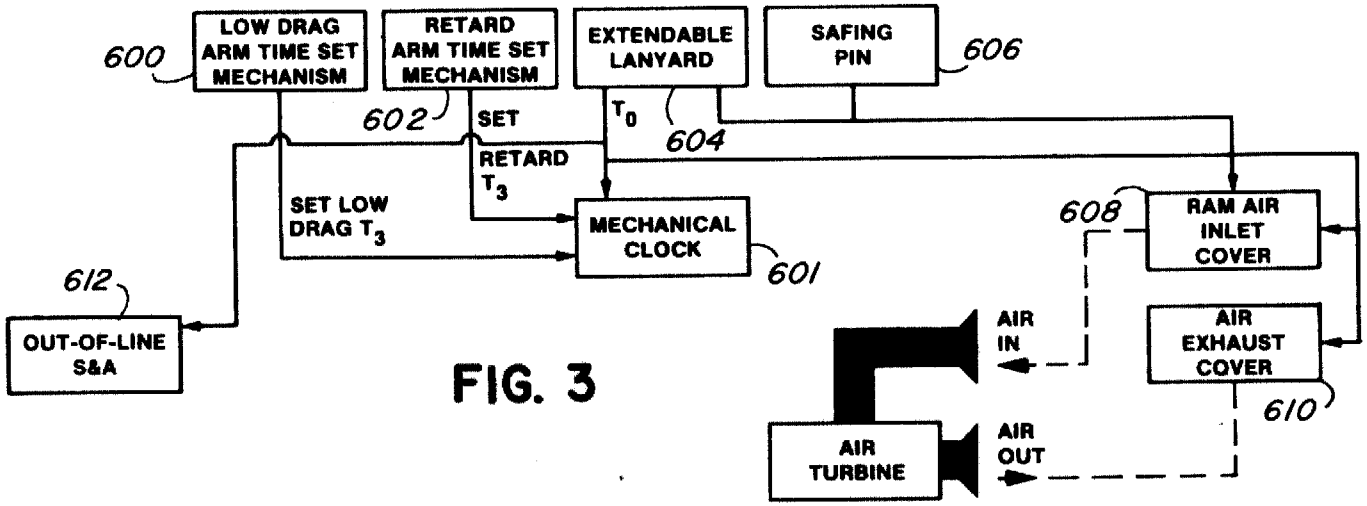
FIG. 3 is a block diagram flowchart of the system of the invention at the time of munition release.

FIG. 3 shows a flowchart of the fuze of the invention at the time of munition release. Low drag arm time set mechanism 600 still supplies low drag $T_3$ timing information to mechanical clock 601. Retard arm time set mechanism 602 supplies retard information for timing of $T_3$ to mechanical clock 601. Safing pin 606 has been removed so that RAM air inlet cover 608 and air exhaust cover 610 may be actuated by means of extendable lanyard 604. Extendable Lanyard 604 is pulled upon release of the munition from the carrying aircraft and time $T_0$ is set into mechanical clock by the actuation of lanyard 604. A lock on out-of-line safing and arming system 612 is also removed by pulling the extendable lanyard 604 at time $T_0$. Mechanical clock 601 begins to run at time $T_0$.

Figure 4:
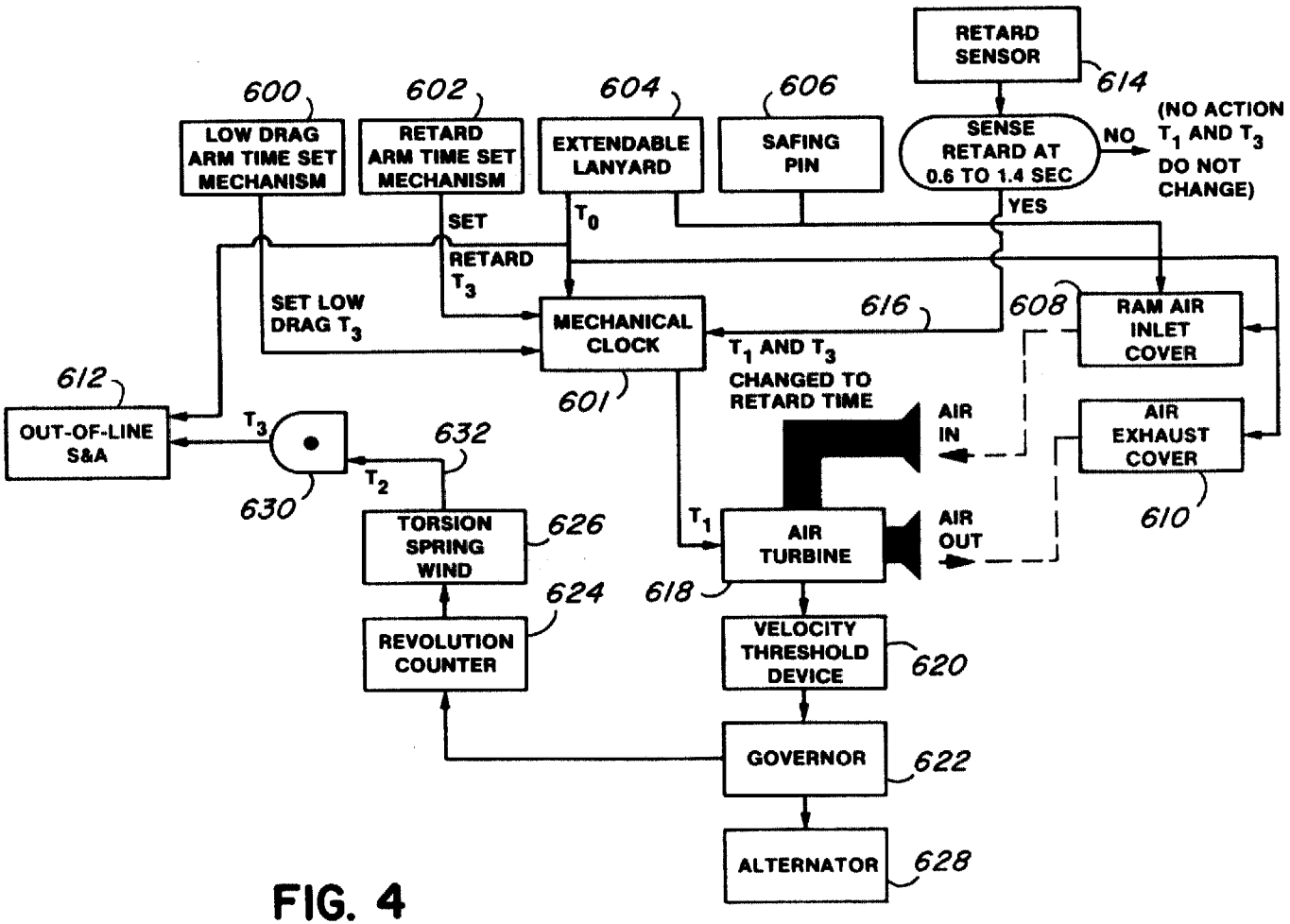
FIG. 4 is a block diagram flowchart of the fuze of the invention at the time of turbine unlock and arm energy availability.

FIG. 4 illustrates the flowchart at the time just subsequent to the drop of the munition. If retard sensor 614 indicates deceleration of the munition between 0.6 and 1.4 seconds after $T_0$ input 616 through the mechanical clock 601 changes times $T_1$ and $T_3$ from low drag operation to retard operation and time $T_1$ and $T_3$ are changed accordingly. That is, times $T_1$ and $T_3$ are under control of the retard setting of the fuze rather than the low drag setting. If retard sensor 614 does not sense deceleration of the fuze within the given time period, $T_1$ and $T_3$ do not change, that is, the low drag arm time set mechanism 600 provides the information to mechanical clock 601. Since safing pin 606 has been removed, extendable lanyard 604 has opened RAM air inlet cover 608 and air exhaust cover 610 allowing air to flow in and out of air turbine 618 and if velocity threshold device 620 is overcome by air turbine 618 the turbine will rotate one-half turn, as previously described. This occurs upon separation of the munition from the carrying aircraft. Mechanical clock 601 also begins to run just subsequent to time $T_0$. At time $T_1$, first release time, mechanical clock 601 releases air turbine 618 so that it may continue to run. Operating through governor 622, air turbine 618 provides energy to revolution counter 624 and to torsion spring wind mechanism 626. Alternator 628 is also energized from air turbine 618. Torsion spring wind mechanism 626 winds the torsion spring and a signal indicating full wind of that spring is sent to AND gate 630 at time $T_2$, indicated by reference numeral 632.

Figure 5:
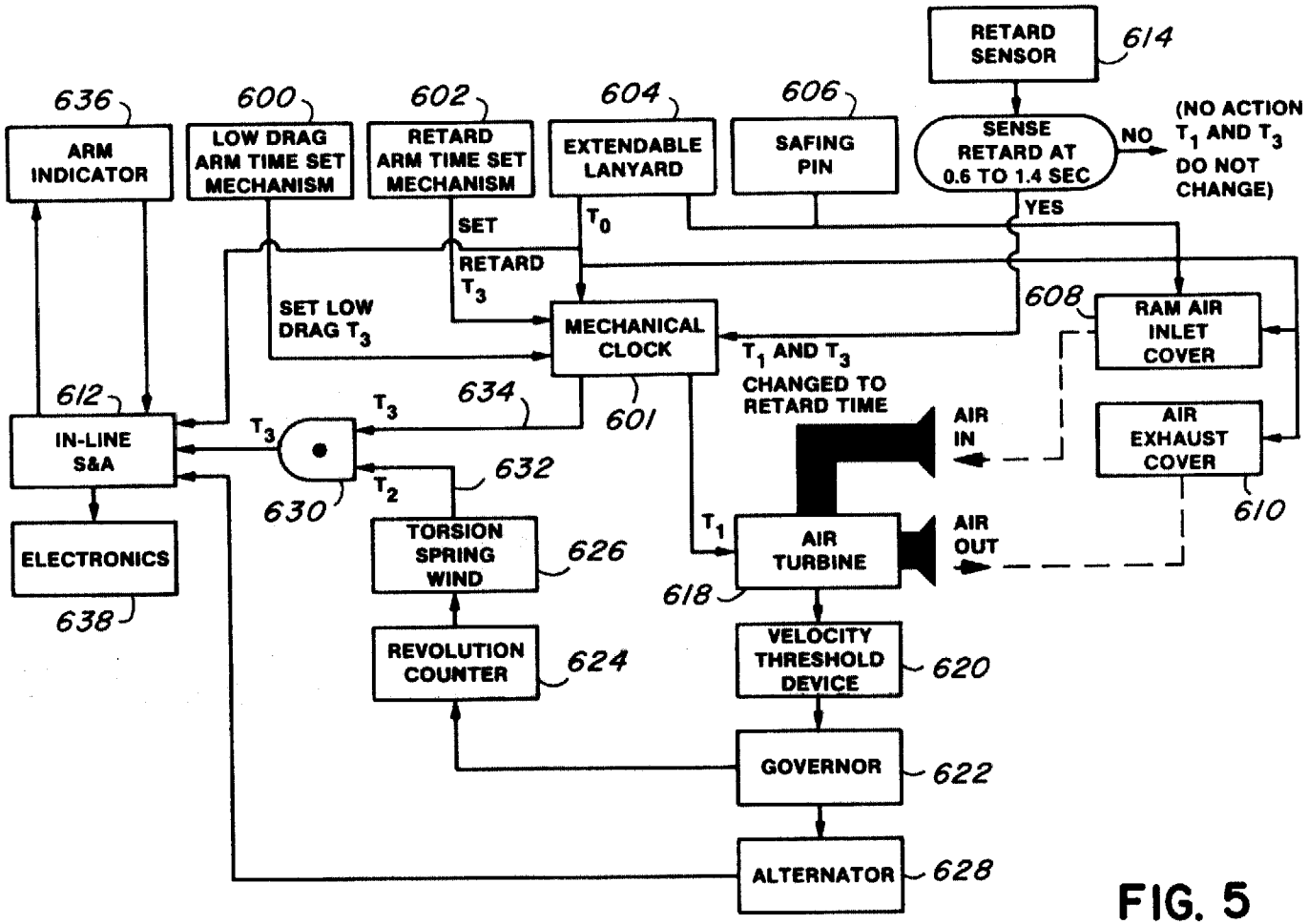
FIG. 5 is a block diagram flowchart of the invention at arm time.

FIG. 5 illustrates a flowchart of the fuze of the invention at arm time. At time $T_3$, mechanical clock 601 puts a second signal, reference numeral 634, into AND gate 630. (The signals into AND gate 630 are mechanical signals and gate 630 is a mechanical device.) Therefore at time $T_3$ AND gate 630 is utilized to transfer torsion energy from spring wind mechanism 626 to safing and arming system 612 to turn it in-line. This operation actuates arm indicator 636 to give an external indication that safing and arming rotor 612 is in line. When safing and arming 612 rotation is complete for the in-line position, the electronics system 638 is powered from alternator 628 through switch contacts in the safing and arming rotor.

Figure 6:
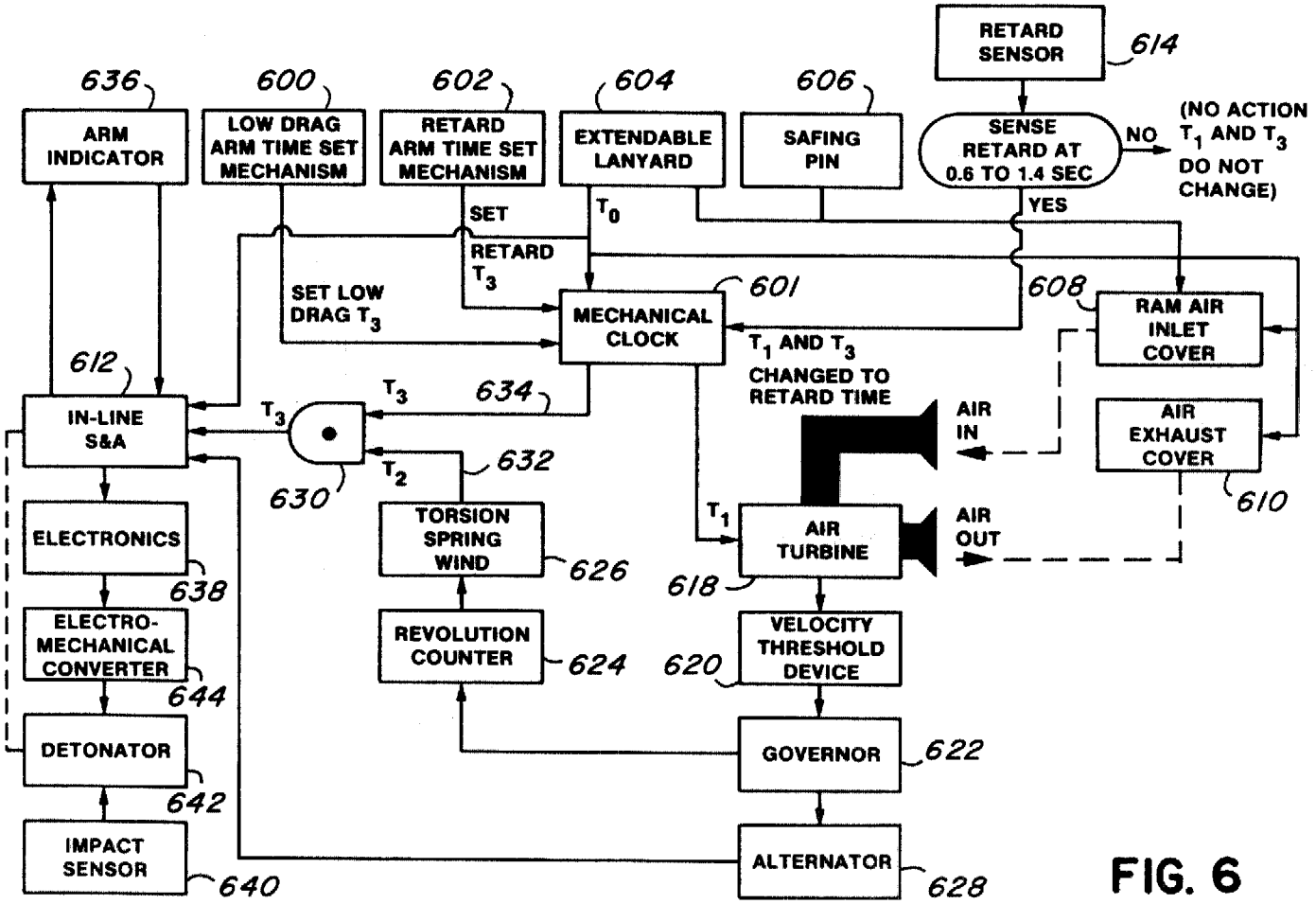
FIG. 6 is a block diagram flowchart of the invention at the time of detonation.

FIG. 6 illustrates a flowchart of the system at the time of detonation. When either electronic system 638 or inpact sensor 640 indicates time for detonation, detonator 642 is impacted. The impact may come directly from impact sensor 640 by mechanical means or from electronics system 638 through electro-mechanical converter 644. Safing and arming rotor 612 being in-line at this time allows detonator 642 to fire and a booster in the munition is thereby actuated (not shown).

Once the armed condition shown in FIG. 5 is reached, that is; safing and arming rotor 612 is in the in-line condition, there is still enough torsion left in spring wind mechanism 626 to provide the energy to move safing and arming rotor 612 out-of-line. This is accomplished by pulling arm indicator 636 as indicated in U.S. Pat. No. 3,842,743, FIG. 4C. Furthermore, as indicated in FIG. 4D of U.S. Pat. No. 3,842,743, once arm indicator 636 is released, safing and arming rotor 612 is locked out-of-line permanently.

While the invention has been particularly shown and described with reference to a preferred embodiment thereof, it will be understood by those skilled in the art that various other modifications and changes may be made to the present invention from the principles of the invention described above without departing from the spirit and scope thereof, as encompassed in the accompanying claims. Therefore it is intended in the appended claims to cover all such equivalent variations as come within the scope of the invention as described.

I claim:

1. A safing and arming timer in a dual purpose fuze for a munition capable of operating in one of a retard mode and a non-retard mode, the timer comprising in combination:

a main spring;

a main shaft, said main shaft connected to said main spring, said main shaft being urged to rotate in response to an energy input from said main spring;

an escapement, said escapement being coupled to said main shaft, said escapement providing a governing action to said urged rotation of said main shaft;

a first timing cam;

a second timing cam;

a cam follower, said cam follower being driven by said main shaft, said cam follower following one of said cams;

means for sensing one of a non-retard and a retard mode in said munition;

means responsive to said sensing means for selecting said one of said cams for following by said cam follower; and output means for arming said fuze responsive to at least one position of said cam follower with respect to said one of said cams.

2. The safing and arming timer according to claim 1 wherein said at least one position comprises:

a first position, said cam follower being responsive to said first position to control a first output function of said timer; and a second position, said cam follower being responsive to said second position to control a second output function of said timer.

3. A dual purpose safing and arming timer for a retard/non-retard munition comprising in combination:

means for sensing one of the retard and non-retard modes of the munition, said means for sensing further comprising:

means for double sensing said retard mode, said double sensing means requiring a first sensing at a first time and a second sensing at a time subsequent to said first time;

means for responding to said sensing of the retard mode to provide a first selected arm time; and means for responding to said sensing of the non-retard mode to provide a second selected arm time.

4. The safing and arming timer according to claim 3 further comprising:

output means for controlling a fuze input energy source.

5. The safing and arming timer according to claim 4 wherein said output means further comprises:

first output means for providing a first output function of the timer at a first time; and second output means for providing a second output function of the timer, said second output means having an output that is subsequent in time to said first time of said first output means output.

* * * * *